US006609287B2

(12) United States Patent
Evans et al.

(10) Patent No.: US 6,609,287 B2
(45) Date of Patent: Aug. 26, 2003

(54) COSMETIC CONTAINER CAP

(75) Inventors: Christopher T. Evans, Long Valley, NJ (US); Christopher Gieda, Long Valley, NJ (US)

(73) Assignee: Sussex Technology, Inc., Sparta, NJ (US)

( * ) Notice: Subject to any disclaimer, the term of this patent is extended or adjusted under 35 U.S.C. 154(b) by 174 days.

(21) Appl. No.: 09/734,151

(22) Filed: Dec. 11, 2000

(65) Prior Publication Data

US 2002/0070192 A1 Jun. 13, 2002

(51) Int. Cl.[7] ..... B23P 11/02; B21D 39/00; B65D 51/24; B65D 41/00

(52) U.S. Cl. ..... 29/451; 29/450; 29/505; 215/303; 215/305

(58) Field of Search ..... 29/450, 428, 451, 29/505, 506, 515, 516, 520, 525; 215/216, 217, 218, 219, 220, 277, 303, 305

(56) References Cited

U.S. PATENT DOCUMENTS 3,888,375 A * 6/1975 Gerk ..... 215/219

* cited by examiner

*Primary Examiner*—John C. Hong
(74) *Attorney, Agent, or Firm*—Duane Morris LLP

(57) ABSTRACT

An improved cosmetic container cap assembly includes a molded plastic base cap including a wall having an inner surface for mating with a container and an outer surface including a plurality of substantially parallel vertical ribs disposed on the outer surface of the wall. The cosmetic container cap assembly also includes a molded plastic shell sized to surround the outer surface of the base cap and including a wall having an inner surface and an outer surface, the inner surface including a plurality of substantially parallel vertical ribs disposed to mate with the vertical ribs of the base cap. The ribs of at least one of the base cap or the shell include a plurality of protruded portions extending from the ribs that plastically deform when the shell is fitted over the outer surface of the base cap to secure the base cap through an interference fit.

7 Claims, 5 Drawing Sheets

COSMETIC CONTAINER CAP

FIELD OF THE INVENTION

The present invention is related to container caps generally, and more specifically to container caps having outer shells and methods of making the same.

DESCRIPTION OF THE RELATED ART

FIG. 1A is an exploded perspective view of a prior art cosmetic container assembly 10. FIG. 1B is a cross sectional view of the cap portions 110, 120 of the prior art cosmetic container assembly 10. Cosmetic container assemblies, such as are popular for nail polishes, typically include a container 140 and brush 130. The brush 130 is typically secured to a cap 120 through an interference fit between walls 124*a*, 124*b* of the cap 120. FIG. 1C is a bottom plan view of cap 120 viewed along lines 3—3 of FIG. 1A and depicting walls 124*a*, 124*b*. FIG. 1D is a top plan view of brush 130. Alternatively, wall 124*a* may be absent from the interior of cap 120 and a brush may be sized to fit against the inner surface of wall 124*b*. Threads 126, which may be formed during molding and facilitate removal of a mold, may help to further secure brush 130. The container 140 is secured to cap 120 through complimentary threads 142*a*, 142*b*.

A cosmetic shell 110 is often placed over a cap 120. It is desirable that the cosmetic shell be aesthetically pleasing in order to promote the cosmetic product. For example, it is generally preferred that the shell have a glossy or shiny appearance. This appearance may be achieved by fitting a gold or silver colored metal shell over a cap. This shell may be as thin as twenty thousandths of an inch. When a metal shell is fitted over a cap 120, the cap 120 does not include threads 122*a*, and the metal shell is typically glued to the cap 120.

This prior art metal shell configuration suffers from several problems. First, metal shells are expensive to produce. Second, assembling this metal shell configuration requires a gluing stage, thereby adding additional costs to the assembly process as well as additional assembly time.

In order to avoid the problems associated with the metal shell configuration, cosmetic shells 110 have been introduced which are formed from a glossy or shiny plastic. The shells 110 and cap 120 include cooperable threads 122*a*, 122*b* for securing the cap 120 to the shell 110. Alternatively, the shell 110 may include a continuous ridge or series of lugs which extend from its inner surface and allow the cap 120 to snap-fit to the shell 110. There are also problems associated with this plastic shell configuration.

First, the threads 122*b*, ridges, or lugs disposed on the inner surface of the shell 110 are visible on the outer surface of the shell 110 as distortions due to sunken-in areas ("sinks") that occur on the surface of the thin plastic shell. It is believed that the sinks form because of differences in solidification rates, i.e., regions of the shell with larger cross sectional thicknesses (e.g., thread regions) shrink more than areas with thinner cross sectional thicknesses (e.g., groove regions) when cooled within a mold. These sinks distort the appearance of the outer shell, particularly when the shell is held at an oblique angle relative to a light source. It is generally recommended that to avoid visible sinks, the distance an internal feature, such as a thread or a lug, extends from a molded wall should not be greater than a third, and more preferably, not more than a quarter, of the thickness of the wall from which it protrudes. Thus, the sinks are not visible if the wall of the shell of a plastic container cap assembly is made sufficiently thick. This additional thickness, however, detracts from the overall aesthetic appearance of the container cap assembly by increasing the overall size of the cap assembly and departing even further from the desired thin metal shell appearance.

The need for cooperable threads 122*a*, 122*b* may be avoided by gluing a shell 110 to the cap 120. However, the gluing process introduces additional problems, as discussed above. Therefore, there is presently a need for a more cost effective, but still aesthetically pleasing, cosmetic container cap.

SUMMARY OF THE INVENTION

The present invention provides a container cap assembly and method of making the same. A container cap assembly according to the present invention includes a molded plastic base cap including a wall having an inner surface for mating with a container and an outer surface. The outer surface includes a plurality of substantially parallel vertical ribs disposed on the outer surface. The container cap assembly also includes a molded plastic shell sized to surround the outer surface of the base cap. The shell includes a wall having an inner surface and an outer surface. The wall includes a plurality of substantially parallel vertical ribs disposed on the inner surface. The ribs of the shell are disposed to mate with the ribs of the base cap. The ribs of at least one of the base cap and the shell include a plurality of protruded portions extending from the ribs. The shell is fitted over the base cap such that the ribs of the shell frictionally mate with the ribs of the base cap to substantially reduce relative torsional movement between the shell and base cap during the removal of the cap from the container. The protruded portions also deform, either plastically or elastically, when the shell is fitted over the outer surface of the base cap such that the shell is secured to the base cap through an interference fit.

The present invention also provides for another container cap assembly having a molded plastic base cap and molded plastic shell cap. The molded plastic base cap includes a wall having an inner surface for mating with a container and an outer surface. The molded plastic shell cap is sized to surround the outer surface of the base cap and the shell includes a wall having an inner surface and an outer surface. The wall of the base cap or the wall of shell include a plurality of substantially parallel horizontal ribs disposed on the inner surface of the wall of the shell or the outer surface of the wall of the base cap. The ribs include a plurality of protruded portions extending from the ribs such that the protruded portions deform when the shell is fitted over the outer surface of the base cap to secure the base cap and shell cap through an interference fit.

The present invention provides the benefit of cost effective manufacturing with improved aesthetic appearance. The above and other features of the present invention will be better understood from the following detailed description of the preferred embodiments of the invention which is provided in connection with the accompanying drawings.

DETAILED DESCRIPTION

Figure 1A:
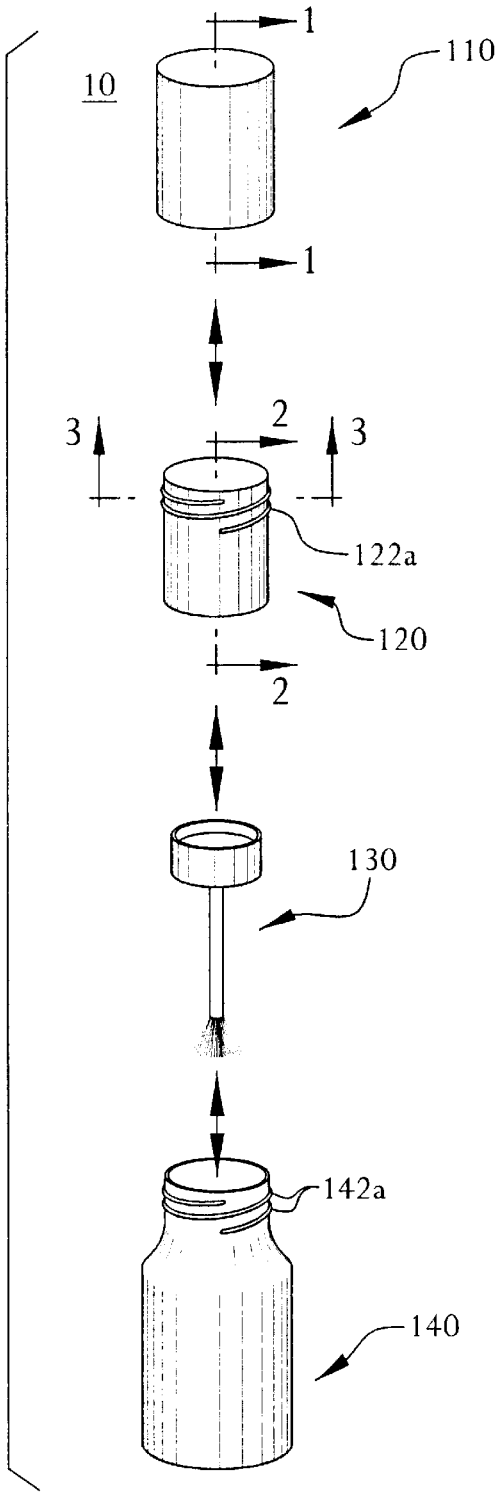
FIG. 1A (PRIOR ART)
FIG. 1A is an exploded perspective view of a prior art container cap assembly including brush and container.
Figure 1B:
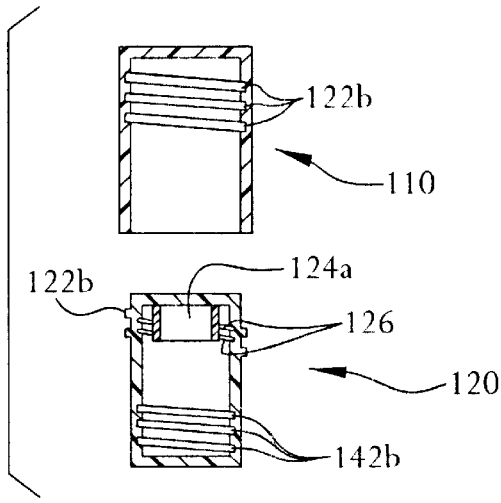
FIG. 1B (PRIOR ART)
FIG. 1B is a cross sectional view of the shell and cap of FIG. 1A taken along lines 1—1 and 2—2, respectively.
Figure 1C:
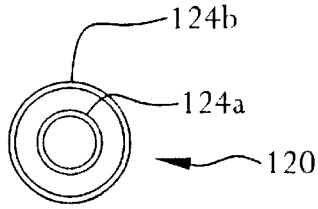
FIG. 1C (PRIOR ART)
FIG. 1C is a bottom plan view of a prior art cap 120 viewed along lines 3—3 of FIG. 1A.
Figure 1D:
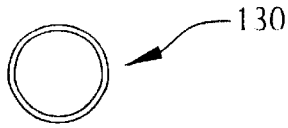
FIG. 1D (PRIOR ART)
FIG. 1D is a top plan view of a prior art brush 130.
Figure 2:
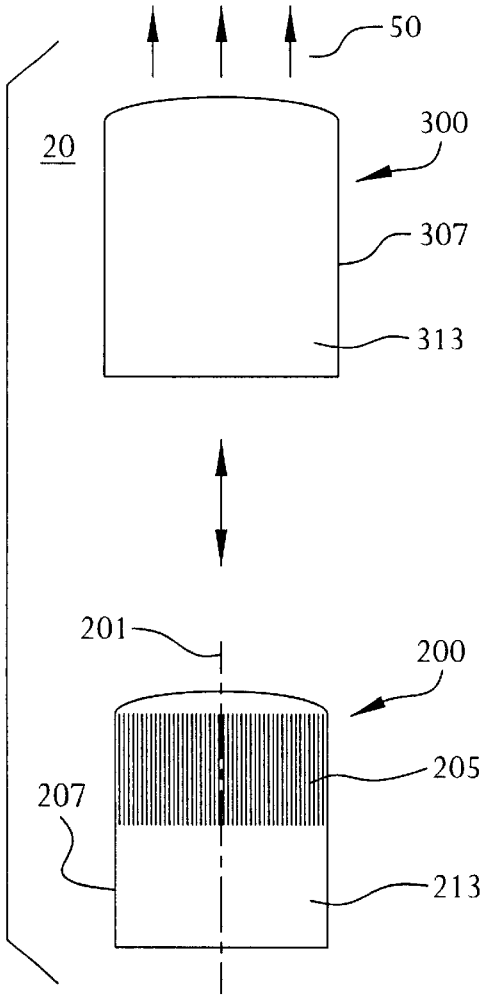
FIG. 2 is an exploded side elevational view of an exemplary container cap assembly according to the present invention.
Figure 3:
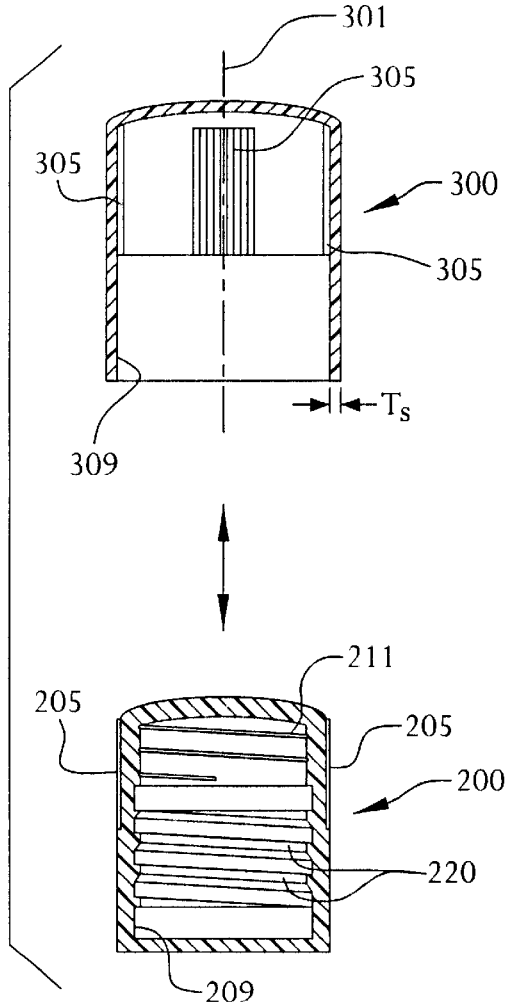
FIG. 3 is a cross sectional view of the shell and base cap of FIG. 2.

FIG. 2 is an exploded side elevational view of an exemplary container cap assembly 20 according to the present invention, and FIG. 3 is a cross-sectional view of the cap assembly 20 of FIG. 2. The container cap assembly 20 includes a molded plastic base cap 200. The base cap 200 includes a wall 207 having an inner surface 209 for mating with a container. The inner surface 209 may include a plurality of threads 220 disposed to mate with a plurality of complimentary threads of a container, such as threads 142*a* of container 140. Likewise, threads 211 may be formed during molding of the base cap 200 to help secure a brush 130 through an interference fit between inner surface 209 of the base cap 200 and the brush. Additionally or alternatively, a second circumferential wall (not shown), such as a wall 124*a* described with the prior art base cap 120, may be formed to further secure a brush 130 within base cap 200.

Figure 4A:
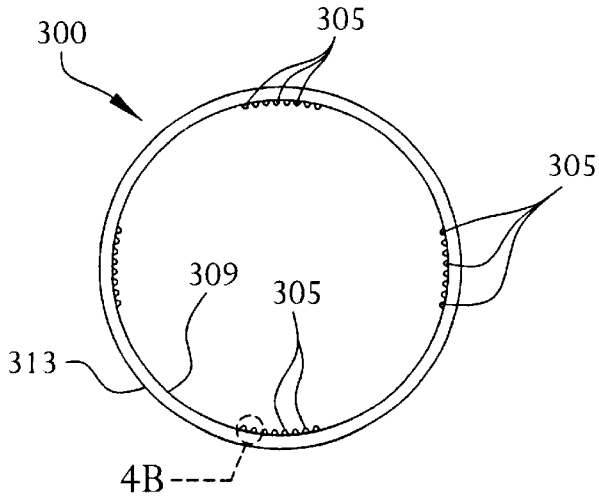
FIG. 4A is a bottom plan view of an exemplary shell according to the present invention.
Figure 4B:
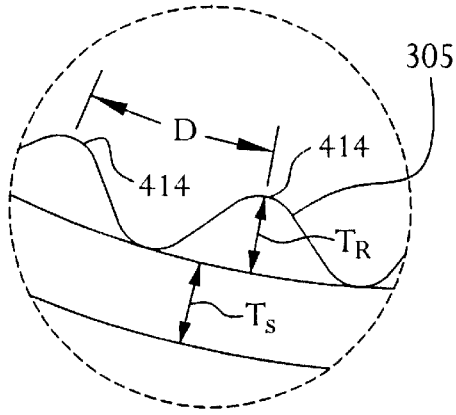
FIG. 4B is an enlarged view of a portion of the shell of FIG. 4A.
Figure 5A:
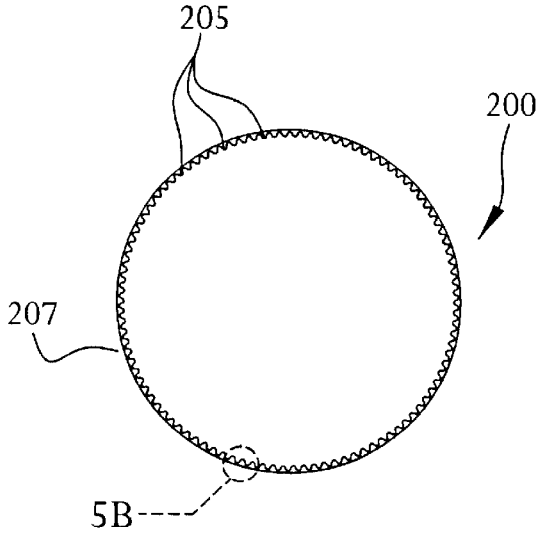
FIG. 5A is a top plan view of an exemplary base cap according to the present invention.
Figure 5B:
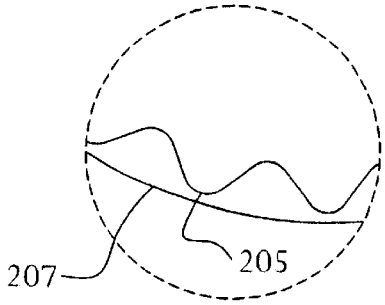
FIG. 5B is an enlarged view of a portion of the base cap of FIG. 5A.

The container cap assembly 20 also includes a shell 300 sized to surround the outer surface 213 of the base cap 200. The shell 300 includes a wall 307 having an inner surface 309 and an outer surface 313. The inner surface 309 of wall 307 includes a plurality of substantially parallel vertical ribs 305. These ribs 305 are better illustrated in FIG. 4A, which is a bottom plan view of the shell 300, and FIG. 4B, which is an enlarged view of a portion of the shell 300. The ribs 305 of the shell 300 are disposed to mate with a plurality of substantially parallel vertical ribs 205 of the base cap 200 (FIGS. 2, 3 and 5) when the shell 300 is fitted over the base cap 200. The ribs 205 of base cap 200 are disposed on the outer surface 213 of wall 207 of the base cap 200. The vertical ribs 205, 305 are preferably evenly spaced, as depicted in FIGS. 4 and 5.

Vertical ribs 305 frictionally mate with vertical ribs 205 when the shell 300 is fitted over the base cap 200 to substantially reduce torsional movement between the shell 300 and the base cap 200. This mating fit helps secure the shell 300 and base cap 200 together to avoid relative rotational displacement of the shell 300 and base cap 200, particularly when the base cap 300 is secured to a container in a mating thread fashion as described above whereby a container cap assembly 20 is removed from or secured to a container 140 by rotating the cap assembly 20 relative to the container.

Figure 6:
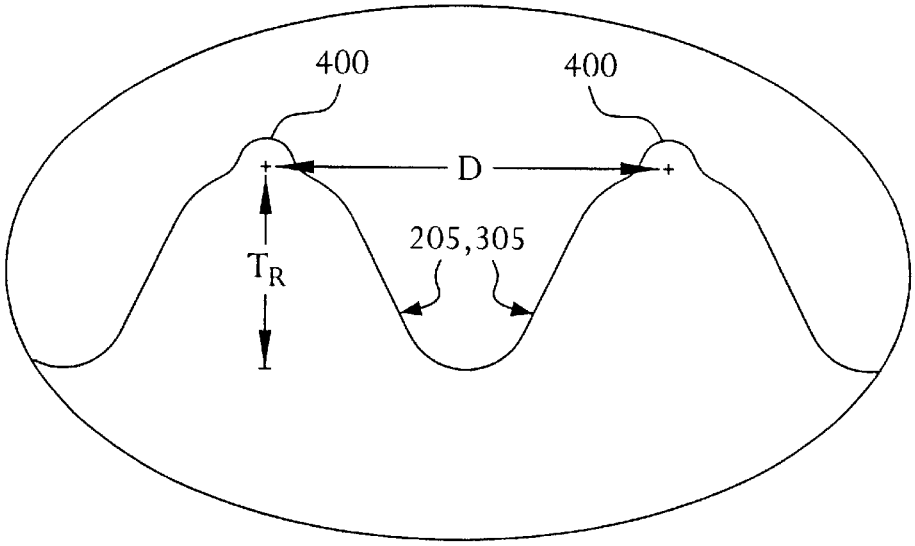
FIG. 6 is an enlarged view of a rib according to the present invention including a protruded portion extending therefrom.

The mating vertical ribs 305, 205 also provide resistance against pull-apart or upright pull forces to help secure the shell 300 over the base cap 200. These upright pull forces are designated generally by directional arrows 50 in FIG. 2. Additional resistance against upright pull forces is provided when either one or both of the vertical ribs 205, 305 of the base cap 200 or the shell 300, respectively, includes a plurality of protruded portions 400, as shown in FIG. 6. A protruded portion 400 may extend continuously along an individual rib, or protruded portions 400 may be spaced periodically along an individual rib (such as in a serrated pattern). Likewise, protruded portions 400 may extend from each rib or in a patterned sequence, e.g., every other rib, or randomly among the ribs. Further, it should be understood that the extending protruded portions are integral with their associated ribs, i.e., the ribs' geometries are designed to provide for the protruded portions.

As mentioned, protruded portions 400 preferably extend from a plurality of the vertical ribs of either, or both, of the vertical ribs of the base cap 200 and shell 300. The protruded portions plastically or elastically deform when the shell 300 is fitted over the outer surface 213 of the base cap 200 to provide an improved resistance against upright pull forces and torsional forces, as compared to mating of the vertical ribs 205, 305 alone. The protruded portions deform to create an increased mating surface area, or frictional press fit, or plastic bond between the ribs 205 of the base cap 200 and the ribs 305 of the shell 300. To this end, in a completed assembly, the maximum diameter of the outer wall of the base cap 200, including any protruded portions 400, is preferably about slightly greater than the minimum diameter of the aligning or mating portion of the inner surface of shell 300, including any protruded portions 400, thereby promoting the deformation of the protruded portions 400 during insertion of the base cap 200 into the shell 300.

The preferred location and timing of the deformation of the protruded portions during assembly of the container cap 20 may be controlled by slightly tapering both the inner surface 309 of the shell 300 and the outer surface 213 of the base cap 200 from top to bottom such that the top circumferences are slightly smaller than the bottom circumferences and mating surfaces are sized to promote the deformation of the protruded portions 400 as discussed above. In so doing, the protrusions of the ribs do not begin to deform until approximately the outer circumference of the base cap 300 and the inner circumference of the shell cap 200 approximately equal each other during insertion of the base cap 200 into the shell 300.

It is expected that the configuration, displaced angle, and degree of frictional mating can vary over a wide range. For example, the ribs 305, 205 need not be completely parallel to the central axis 301 of the shell 300 or central axis 201 of the base cap 200, and can vary as much as ±85° from parallel to said axes 201 and 301. Moreover, the shape of the ribs 305, 205 and protruded portions 400 can take on any geometry, including pin shapes, ovals, squares, etc . . . . Furthermore, the protruded portions can be located anywhere along the mating surfaces of the shell 300 or base cap 200. The protruded portion need not be made of the same material as the shell 300 or base cap 200, and may, for example, be made of a softer or more resilient material, such as silicone, synthetic rubber, or a lower strength polymer, such as polyethylene.

The thickness of the wall 307 of the shell 300 preferably ranges between, but not limited to, twenty-five to sixty thousandths of an inch. The vertical ribs 305 of the shell 300 preferably extend a distance from the inner surface 309 of wall 307 that is less than one third, and more preferably one quarter, of the thickness of the wall 307 of shell 300. In one example of an exemplary shell 300 and base cap 200, the shell 300 may have a thickness, designated generally as $T_S$ in FIGS. 3 and 4, of sixty thousandths of an inch. Exemplary vertical fibs 305 of shell 300 may have a thickness, $T_R$, of then thousandths of an inch. A protruded portion 400 may be approximately three thousandths of an inch high and three thousandths of an inch wide. The protruded portions 400 are sized such that they plastically deform during assembly of a container cap assembly 20, whereas larger, more resilient protrusions may deform the vertical ribs 205, 305. Such fine molding detail, while approaching molding limits, is still possible using known carbon electrode mold fabrication techniques.

The container cap assembly 20 according to the present invention may be configured to provide resistance against at least a ten pound upright pull force, a common test standard in the cosmetic industry. Such a configuration, while providing excellent pull apart resistance when the shell 300 and base cap 200 are mated, also provides an aesthetically pleasing shell because no sink voids are visible to the naked eye.

The preferred plastic material for the shell 300 and base cap 200 include polyolefins, but may also be materials such as styrenes, polyesters, or resin materials.

Figure 7:
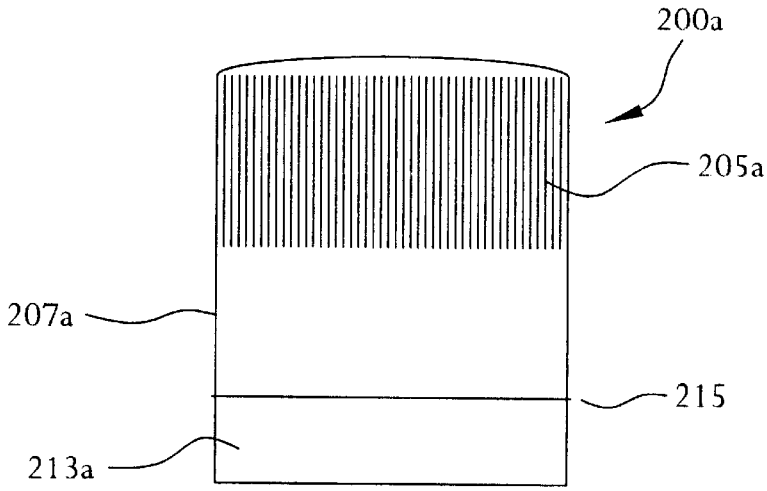
FIG. 7 is a side elevational view of another exemplary base cap with a circumferential sealing rib according to the present invention.

FIG. 7 is a side elevational view of another exemplary embodiment of a base cap 200*a* according to the present invention. Base cap 200*a* is similar to base cap 200 and includes a horizontal sealing rib 215 or series of horizontal sealing ribs extending from the outer surface 213*a* of base cap 200*a* circumferentially around base cap 200*a*. This rib is preferably of similar dimension as the ribs 205, 305 described above. The rib 215 mates with the inner surface 309 of the shell 300 when the container cap assembly is assembled and preferably creates a substantially air tight seal between the shell and base cap 200 under normal upright pull forces. It is believed that this seal helps to create a small vacuum between the assembled areas above and below the seal, thereby increasing the assembly's resistance to upright pull-apart forces.

Figure 8:
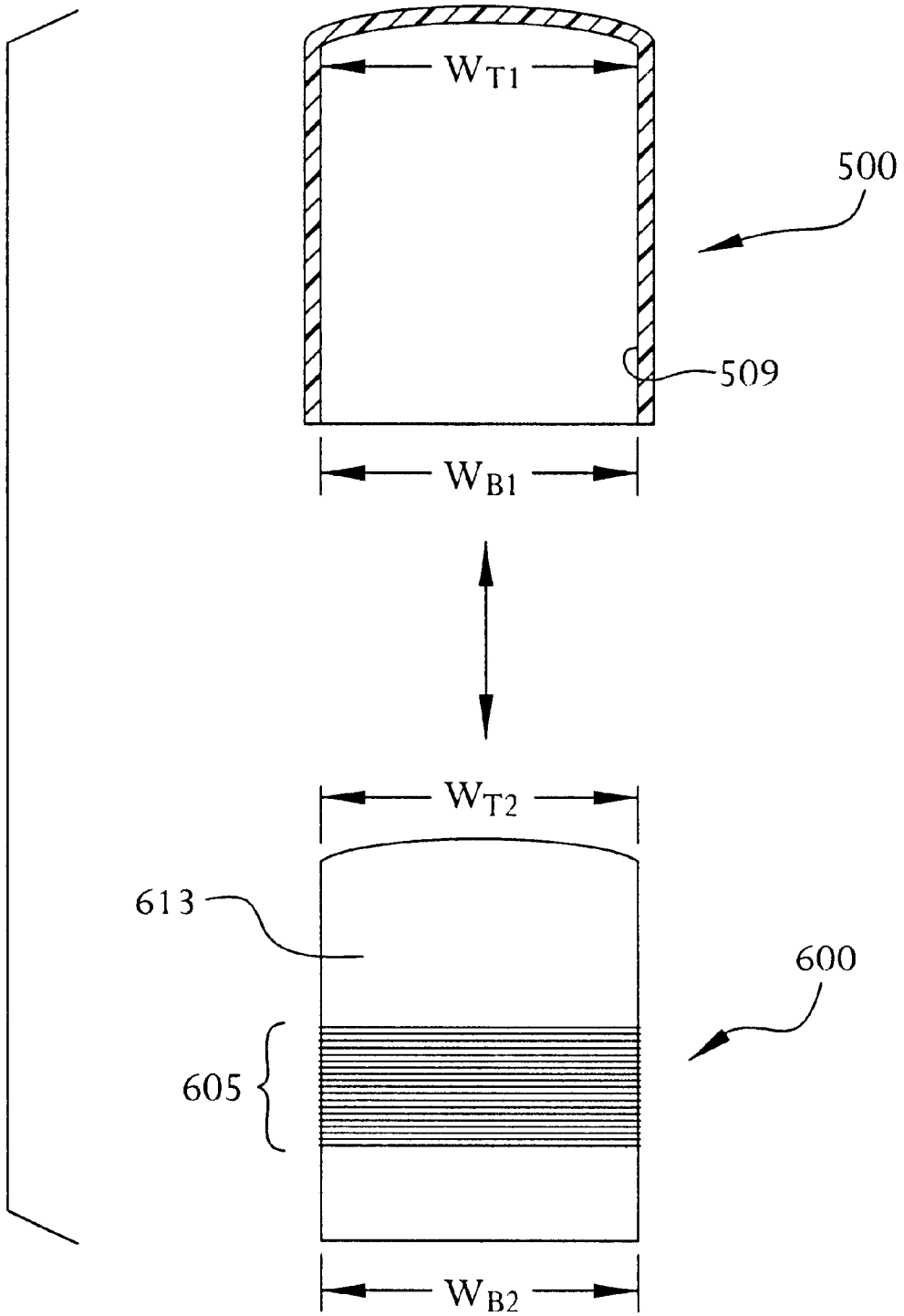
FIG. 8 is an exploded view of another exemplary container cap assembly according to the present invention.

FIG. 8 is an exploded view of another exemplary container cap assembly according to the present invention. Shell 500 is shown in cross-section. Shell 500 includes a smooth inner surface 509 and is sized to fit over the base cap 600. The base cap 600 includes a plurality of substantially parallel horizontal ribs 605. The ribs 605 include a plurality of protruded portions (not shown), as described above and shown in FIG. 6. The number and size of the protruded portions and ribs 605 are selected such that the protruded portions plastically or elastically deform when the shell 500 is fitted over the outer surface 613 of the base cap 600 to provide an improved resistance against upright pull forces and torsional forces. This mating fit helps secure the shell 500 and base cap 600 together to avoid relative rotational displacement of the shell 500 and base cap 600, particularly when the base cap 500 is secured to a container in a mating thread fashion as described above whereby a container cap assembly is removed from or secured to a container 140 by rotating the cap assembly relative to the container The shell 500 and base cap 600 are preferably sized to taper from top to bottom, i.e., the top widths $W_{T1}$, $W_{T2}$ of the inner surface 509 of shell 500 and the outer surface 613 of the base cap 600 are sized to be slightly smaller than the bottom widths $W_{B1}$, $B_{B2}$ of the shell 500 and base cap 600, respectively. In so doing, the shell 500 and base cap 600 may be sized to allow the protruded portions to deform sequentially as the shell 500 is fitted over the base cap 600. The protruded portions, thereby, do not prematurely deform before they contact the portion of the inner surface 509 of the shell 500 which they are disposed to mate with in a completed assembly.

Alternatively, the substantially horizontal ribs 605 and protruded portions may be disposed on the inner surface 509 of the shell, to mate with the outer surface 613 of the base cap 600. In still another embodiment of the present invention, the shell 300 and base cap 200 of the assembly 20 may be formed substantially as shown in FIGS. 2 and 3. The lower portion of the outer surface 213 of the base cap may further include a plurality of substantially parallel horizontal ribs (not shown) with a plurality of protruded portions extending from the ribs, such as described above in conjunction with shell 500 and base cap 600.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A method of assembling a container cap, comprising:

(a) providing a molded plastic base cap, said base cap including:

a wall having an inner surface and an outer surface, said wall including a plurality of substantially parallel vertical ribs disposed on said outer surface;

(b) providing a molded plastic shell sized to surround a portion of said outer surface of said base cap, said shell including:

a wall having an inner surface and an outer surface, said wall including a plurality of substantially parallel vertical ribs disposed on said inner surface, said ribs of said shell disposed to mate with said ribs of said base cap, said ribs of at least one of said base cap and said shell cap including a plurality of protruded portions extending from said ribs; and (c) fitting said shell over said base cap to assemble said container cap such that said ribs of said shell frictionally mate with said ribs of said base cap to substantially reduce relative torsional movement between said shell and base cap during the removal of said container cap from a container, wherein said protruded portions deform when said shell is fitted over said outer surface of said base cap such that said shell is secured to said base cap through an interference fit.

2. The method of claim 1, wherein said protruded portions are disposed on said ribs of said base cap and said ribs of said shell.

3. The method of claim 1, wherein said ribs of said shell are sized such that sink voids are not visible to the naked eye on said outer surface of said wall of said shell.

4. The method of claim 3, wherein said ribs of said shell extend a distance from said inner surface of said wall of said shell that is less than one third of the thickness of said wall of said shell.

5. The method of claim 4, wherein said ribs of said shell extend a distance from said inner surface of said wall of said shell that is less than one quarter of the thickness of said wall of said shell.

6. The method of claim 1, further comprising the steps of providing a container and securing said base cap to said container.

7. The method of claim 1, wherein said shell is fitted over said base cap such that said shell and base cap withstand a pull-apart force of at least 10 pounds.

* * * * *